US005739094A

United States Patent [19]

Bowman et al.

[11] Patent Number: 5,739,094

[45] Date of Patent: Apr. 14, 1998

[54] FREE-FLOWING PARTICULATE DETERGENT ADMIX COMPOSITION CONTAINING NONIONIC SURFACTANT

[75] Inventors: John Patrick Bowman, Southgate; John Michael Jolicoeur, Fort Mitchell, both of Ky.

[73] Assignee: The Procter & Gamble Company, Cincinnati, Ohio

[21] Appl. No.: 785,208

[22] Filed: Jan. 17, 1997

[51] Int. Cl.[6] ..... C11D 1/825; C11D 17/06

[52] U.S. Cl. ..... 510/327; 510/349; 510/356; 510/360; 510/394; 510/438; 510/441; 510/471; 510/505; 510/515

[58] Field of Search ..... 510/327, 349, 510/356, 360, 394, 438, 441, 471, 505, 515; 252/159, 242, 244, 240

[56] References Cited

U.S. PATENT DOCUMENTS

| | | | |
|---|---|---|---|
| 2,461,043 | 2/1949 | Eisen | 117/139.5 |
| 3,652,419 | 3/1972 | Karg | 252/8.8 |
| 3,827,114 | 8/1974 | Crossfield | 28/75 WT |
| 4,006,110 | 2/1977 | Kenney et al. | 252/540 |
| 4,486,327 | 12/1984 | Murphy et al. | 252/94 |
| 4,637,891 | 1/1987 | Delwel et al. | 252/135 |
| 4,652,392 | 3/1987 | Baginski et al. | 252/109 |
| 4,715,979 | 12/1987 | Moore et al. | 252/91 |
| 4,808,086 | 2/1989 | Evans et al. | 427/242 |
| 5,009,804 | 4/1991 | Clayton et al. | 252/90 |
| 5,102,564 | 4/1992 | Gardlik et al. | 252/8.9 |
| 5,133,892 | 7/1992 | Chun et al. | 252/90 |
| 5,133,924 | 7/1992 | Appel et al. | 264/342 |
| 5,149,455 | 9/1992 | Jacobs et al. | 252/174.13 |
| 5,160,657 | 11/1992 | Bortolotti et al. | 252/174.14 |
| 5,234,610 | 8/1993 | Gardlik et al. | 252/8.6 |
| 5,246,611 | 9/1993 | Trinh | 252/8.6 |
| 5,496,555 | 3/1996 | Colwell | 424/405 |
| 5,503,756 | 4/1996 | Corona, III et al. | 252/8.8 |

FOREIGN PATENT DOCUMENTS

| | | | |
|---|---|---|---|
| 0 736 594 A1 | 4/1995 | European Pat. Off. | C11D 1/66 |
| 1517713 | 10/1974 | United Kingdom | C11D 17/06 |

*Primary Examiner*—Ardith Hertzog
*Assistant Examiner*—Greg Webb
*Attorney, Agent, or Firm*—Ken K. Patel; Jacobus C. Rasser; Kim W. Zerby

[57] ABSTRACT

A free-flowing particulate detergent admix that contains nonionic surfactant is disclosed. The nonionic surfactant is in the form of various sorbitan esters encased in a matrix of a plastic, organic structuring agent that can be readily dissolved or dispersed in an aqueous laundry bath. The nonionic detergent admix can be incorporated in granular laundry detergent products.

5 Claims, No Drawings

FREE-FLOWING PARTICULATE DETERGENT ADMIX COMPOSITION CONTAINING NONIONIC SURFACTANT

FIELD OF THE INVENTION

The present invention generally relates to a free-flowing particulate detergent admix composition containing nonionic surfactant. The particulate detergent admix composition contains selected sorbitan esters and a structuring agent. More particularly, the admix composition contains polyethoxylated and nonethoxylated sorbitan esters and polyethylene glycol. The detergent admix containing the sorbitan esters can be mixed with finished detergent granules to serve as a source of nonionic surfactant, thus avoiding the myriad problems associated with the common practice of spraying oily nonionic surfactants onto the detergent granules.

BACKGROUND OF THE INVENTION

When compared to anionic surfactants, nonionic surfactants are especially useful in detergent products because they are biodegradable, they are less sensitive to water hardness and they foam less strongly in aqueous solutions. In addition, nonionic surfactants exhibit excellent cleaning ability in cold water solutions and are particularly effective in removing silts and clays. Thus, they are a desired ingredient in detergent compositions.

The physical properties of nonionic surfactants, however, make it difficult to manufacture granular detergent compositions with high levels of the surfactant. Low molecular weight nonionic surfactants are typically oily materials that are liquid at room temperature, while higher molecular weight nonionic surfactants have a pasty to waxy consistency. Because they are difficult to process, nonionic surfactants are usually incorporated into detergent compositions by spraying the surfactant in liquid form onto the detergent granules. However, the total level of nonionic surfactant in the detergent product is limited since spraying high levels of these oily liquids onto the detergent matrix will result in "caking" of the detergent product. Such "caking" increases manufacturing costs because it introduces flow and handling difficulties. Moreover, "caked" product is unacceptable to consumers and can lead to difficulties in scooping or otherwise removing the detergent from the box. Also, spraying large amounts of liquid nonionic surfactant on to the detergent granules tends to decrease the density of the final granular detergent product, making the detergent more bulky and cumbersome for the consumer.

Thus, there has been a need in the detergent industry for an alternative means of providing nonionic surfactant cleansing in granular detergent formulations without deleteriously affecting the flow properties of the final product or the appeal of the detergent to consumers. However, attempts to increase the level of nonionic surfactant using the oily spray-on method have largely failed because they do not lead to a free-flowing, high-density granular detergent.

Accordingly, it would be desirable to have a nonionic surfactant containing admix that is economical to manufacture and mix with detergent granules, and that provides a detergent product with excellent cleaning profiles and good consumer appeal.

BACKGROUND ART

The following references relate to detergent granules, the solubility thereof and/or the flow properties of such granules: U.S. Pat. No. 4,715,979 (Moore et al., 1987); U.S. Pat. No. 5,009,804 (Clayton et al., 1991); U.S. Pat. No. 4,006,110 (Kenny et al., 1977); U.S. Pat. No. 5,149,455 (Jacobs et al., 1992) and U.S. Pat. No. 4,637,891 (Delwel et al., 1987). The following references are directed to spray-dried granules: U.S. Pat. No. 5,133,924 (Appel et al., 1992); U.S. Pat. No. 5,160,657 (Bortolotti et al., 1992); and British Patent No. 1,517,713, (Johnson et al., 1974). The following references disclose the use of various sorbitan ester compounds or derivatives to treat fabrics: Atlas Powder Company Bulletin No. 9, "Industrial Emulsions with Atlas Surfactants," (1953); U.S. Pat. No. 2,461,043; (Eisen et al., 1955); U.S. Pat. No. 3,652,419 (Karg et al., 1972) and U.S. Pat. No. 3,827,114 (Crossfield et al., 1974). The following reference relates to using structuring agents in detergent formulations: U.S. Pat. No. 4,652,392 (Baginski et al., 1987).

SUMMARY OF THE INVENTION

The present invention meets the needs identified above by providing a particulate detergent admix having high levels of nonionic surfactant that can be incorporated into granular laundry products. The claimed composition eliminates the need to spray oily nonionic surfactants onto laundry detergent granules, thereby avoiding the handling difficulties that arise when the granules become tacky from the nonionic spray. The present invention also avoids the problem of density loss in the detergent granules that can occur when excess nonionic surfactant is sprayed on the detergent matrix. The claimed admix composition is particularly useful when incorporated in granular laundry products that contain no zeolite or carbonate, materials which are effective absorbents for nonionic surfactant, as well as in detergent products containing high levels of bleach.

In accordance with one aspect of the invention, a free-flowing particulate detergent admix composition for inclusion in a granular detergent product is provided. Specifically, the composition comprises from about 5% to about 80% by weight of a sorbitan ester having the formula:

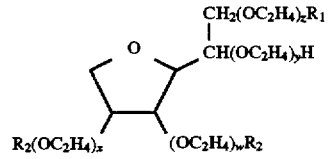

wherein W+X+Y+Z equals from 0 to 40, $R_1$ is $(C_nH_{2n+1})COO$, $R_2$ is (OH) or $(C_nH_{2n+1})COO$, and n is an integer of from 11 to 17; and from about 20% to about 95% by weight of a structuring agent. In another embodiment of the invention, the sorbitan ester is selected from the group consisting of polyethoxylated esters, nonethoxylated esters, and mixtures thereof. Preferably, the polyethoxylated ester is polyethoxylated sorbitan tristearate having 20 ethoxy groups, wherein according to the above formula $R_1$ and $R_2$ are $(C_nH_{2n+1})COO$, n is 17, and W+X+Y+Z equals 20, and the nonethoxylated ester is sorbitan monostearate, wherein according to the above formula $R_1$ is $(C_nH_{2n+1})COO$, n is 17, $R_2$ is (OH), and W+X+Y+Z equals 0. In another embodiment of the invention, the weight ratio of polyethoxylated sorbitan ester to nonethoxylated sorbitan ester is from about 0.1:1.0 to about 5.0:1.0.

In another embodiment of the invention, the structuring agent is polyethylene glycol; preferred is a polyethylene glycol having a molecular weight of from about 1,500 to about 100,000. Additionally, the mean particle size of the free-flowing particulate detergent admix is from about 100 microns to about 2000 microns.

In an especially preferred embodiment of the invention the composition comprises from about 40% to about 60% by weight of a sorbitan ester having the formula:

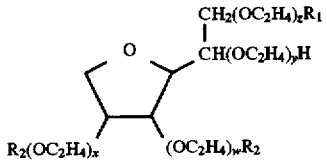

wherein said mixture comprises polyethoxylated sorbitan tristearate, wherein $R_1$ and $R_2$ are $(C_nH_{2n+1})COO$, n is 17, and W+X+Y+Z equals from 0 to 40, and sorbitan monostearate, wherein $R_1$ is $(C_nH_{2n+1})COO$, n is 17, $R_2$ is (OH), and W+X+Y+Z equals 0; and from about 40% to about 60% by weight of a polyethylene glycol having a melting point above room temperature. Preferably, the polyethoxylated sorbitan tristearate has 20 ethoxy groups, wherein W+X+Y+Z equals 20. Also, the weight ratio of the polyethoxylated sorbitan tristearate to the sorbitan monostearate is from about 0.1:1.0 to about 5.0:1.0.

Accordingly, it is an object of the present invention to provide a particulate detergent admix containing high levels of nonionic surfactant that can be mixed with finished detergent granules to avoid the difficulties inherent in prior art processes where the nonionic surfactant is sprayed onto the detergent matrix. It is also an object of the present invention to provide a particulate detergent admix that can be mixed with detergent granules to enhance cleaning performance and consumer appeal of the total detergent product. These and other objects, features and attendant advantages of the present invention will become apparent to those skilled in the detergent art from reading the following detailed description of the preferred embodiment and the appended claims.

All percentage, ratios, and proportions used herein are by weight unless otherwise specified. All documents, including patents and publications, cited herein are incorporated by reference.

DETAILED DESCRIPTION OF THE PREFERRED EMBODIMENT

The detergent admix composition of the present invention comprises two essential ingredients: sorbitan esters and a structuring agent. The sorbitan esters are combined with a structuring agent having a melting point above room temperature, at a temperature sufficient to form a molten mixture. The sorbitan esters and structuring agent, together in the form of a molten mixture, are then treated to form the detergent admix particles. The detergent admix particles are free-flowing, and can be incorporated into granular laundry detergent products. The individual components of the claimed composition and the method of manufacturing the admix are described in detail, below.

SORBITAN ESTER COMPONENT

The first essential ingredient in the free-flowing particulate detergent admix is a sorbitan ester having the formula:

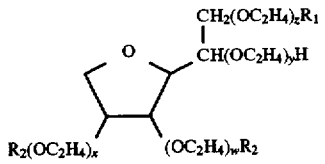

(I)

wherein W+X+Y+Z equals from 0 to 40, $R_1$ is $(C_nH_{2n+1})COO$, $R_2$ is (OH) or $(C_nH_{2n+1})COO$, and n is an integer of from 11 to 17. In preferred embodiments of the process herein, the sorbitan esters are either nonethoxylated (W+X+Y+Z equals 0) or have a degree of ethoxylation of 20 (W+X+Y+Z equals 20). One polyethoxylated sorbitan ester useful in the process herein is polyethoxylated sorbitan monostearate having a degree of ethoxylation of twenty according to formula (I), wherein $R_1$ is $(C_nH_{2n+1})COO$, n is 17, $R_2$ is (OH), and W+X+Y+Z equals 20, i.e., $C_6H_9O_2$ $(C_2H_4O)_{20}$ $(OH)_2$ $(C_{17}H_{35}COO)$. A preferred polyethoxylated sorbitan ester is polyethoxylated sorbitan tristearate having a degree of ethoxylation of twenty according to formula (I), wherein $R_1$ and $R_2$ are $(C_nH_{2n+1})COO$, n is 17, and W+X+Y+Z equals 20, i.e., having the following structure:

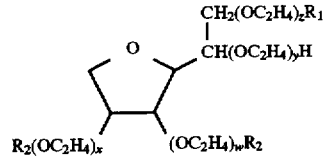

(II)

One nonethoxylated sorbitan ester useful in the process herein is sorbitan monopalmitate according to formula (I), wherein $R_1$ is $(C_nH_{2n+1})COO$, n is 15, $R_2$ is (OH), and W+X+Y+Z equals 0, i.e., $C_6H_9O_2$ $(OH)_2$ $(C_{15}H_{31}COO)$. A preferred nonethoxylated sorbitan ester is sorbitan monostearate according to formula (I), wherein $R_1$ is $(C_nH_{2n+1})COO$, n is 17, $R_2$ is (OH), and W+X+Y+Z equals 0, i.e., having the following structure:

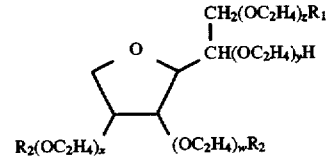

(II)

The above-described sorbitan ester materials are commercially available under several trade names, such as GLYCOSPERSE TS 20 from Lonza (polyethoxylated sorbitan tristearate), GLYCOSPERSE S 20 from Lonza (polyethoxylated sorbitan monostearate), RADIASURF 7145 from Fina (sorbitan monostearate), RADIASURF 7135 from Fina (sorbitan monopalmitate), and ARMOTAN MP from Akzo Nobel (sorbitan monopalmitate).

The admix composition described herein may include a mixture of polyethoxylated and nonethoxylated sorbitan esters. It has been discovered that by incorporating certain ratios of polyethoxylated and nonethoxylated sorbitan esters, the cleaning performance of the particulate detergent admix can be enhanced. Another benefit to varying the ratio of polyethoxylated and nonethoxylated sorbitan esters is that a target surfactant hydrophilic/lipophilic balance in the granular laundry detergent product can be obtained. A weight ratio of polyethoxylated sorbitan ester to nonethoxylated sorbitan ester of from about 0.1:1.0 to about 5.0:1.0 provides excellent cleaning performance, preferably the ratio is from about 1.0:3.0 to about 3.0:1.0, most preferably from about 1.0:2.0 to about 2.0:1.0.

The amount of sorbitan ester used in the claimed composition will vary depending on the cleaning performance objectives for the final granular laundry detergent product. Typically, the sorbitan ester will be present in the detergent admix in an amount of from about 5% to about 80%, preferably from about 25% to about 80%, most preferably from about 40% to about 60%. These ranges are equally applicable when the preferred esters of polyethoxylated sorbitan tristearate and nonethoxylated sorbitan monostearate are used.

STRUCTURING AGENT COMPONENT

The sorbitan ester must be incorporated within (i.e., coated, encapsulated, covered by, internalized, or otherwise substantially contained within) a substantially water-soluble, or water-dispersible, and nonhygroscopic structuring agent which must be impermeable to detergents and alkalinity and which, itself, must be substantially nonsurface active. By "substantially nonsurface active" it is meant that the structuring agent itself does not interact with the sorbitan ester in such fashion that the sorbitan ester is emulsified or otherwise excessively dispersed prior to its release in the wash water, hence reducing the cleaning effectiveness of the sorbitan ester.

Of course, when preparing the free-flowing detergent admix, it is preferable that the structuring agent be substantially dry and nontacky at ambient temperatures. Accordingly, it is preferred herein to use as the structuring agent a plastic, organic compound which can be conveniently melted, mixed with the sorbitan ester, and thereafter cooled to form admix particles. There are a wide variety of such structuring agents useful herein. Since the nonionic sorbitan ester surfactant is to be releasably incorporated in the structuring agent, such that the surfactant is released into the aqueous laundry bath when the granular laundry detergent product containing the nonionic detergent admix is added to wash water, it is preferred that the structuring agent be water soluble. However, water-dispersible materials are also useful since they will also release the sorbitan ester when added to the laundry bath.

A wide variety of structuring agents having the requisite solubility/dispersibility characteristics and the essential features of being substantially nonsurface active, substantially nonhygroscopic and substantially detergent-impermeable are known. However, polyethylene glycol (PEG) which has substantially no surface active characteristics is highly preferred herein. PEG, having molecular weights of from about 1,500 to about 100,000, preferably from about 3,000 to about 20,000, most preferably from about 5,000 to about 10,000 can be used.

Surprisingly, highly ethoxylated fatty alcohols such as tallow alcohol condensed with at least about 25 molar proportions of ethylene oxide are also useful herein. Other alcohol condensates containing extremely high ethoxylate proportions (about 25 and above) are also useful herein. Such high ethoxylates apparently lack sufficient surface active characteristics to interact or otherwise interfere with the desired cleaning properties of the sorbitan esters. A variety of other materials useful as structuring agents herein can also be used, e.g., gelatin; agar; gum arabic; and various algae-derived gels.

The amount of carrier used to isolate the sorbitan ester from the granular detergent product is important, although not critical. It is only necessary that enough structuring agent be used to provide sufficient volume that substantially all the sorbitan ester can be incorporated therein. Likewise, it is preferred to have enough structuring agent to provide for sufficient strength of the resultant admix particle to resist premature breakage. Generally, the structuring agent comprises from about 20% to about 95%, by weight of the detergent admix, preferably from about 20% to about 75%, most preferably from about 40% to about 60%. These amounts are equally applicable when the preferred structuring agent, PEG, is used in the process herein.

FORMING THE DETERGENT ADMIX PARTICLES

The claimed detergent admix composition is manufactured by combining the sorbitan ester with the structuring agent and treating the combination so as to form the free-flowing detergent admix particles. The structuring agent and the sorbitan ester can be combined through any number of conventional methods known to those of average skill in the art. One useful method is to first mix the structuring agent and the sorbitan ester at a temperature above the melting point of both components so as to form a molten mixture having the sorbitan ester dispersed throughout the liquefied structuring agent. In order to form a supporting matrix upon cooling, the molten mixture should have a melting/freezing point greater than 37.8° C., preferably greater than 43.3° C., most preferably greater than 48.9° C. It is recognized that there are numerous possible variations in the above-described method that would accomplish the same result of dispersing the sorbitan ester throughout the structuring agent medium. However, the critical aspect of this step is that the molten mixture have a melting/freezing point above room temperature so that the structuring agent can form a supporting matrix for holding the nonionic surfactant sorbitan ester during storage of either the particulate detergent admix or a granular detergent product containing the same. By "room temperature" is meant temperatures between 15.6° C. and 37.8° C.

After dispersing the sorbitan ester in the structuring agent medium, the molten mixture is treated so as to form the detergent admix particles. One method of accomplishing this is to cool the mixture so that the structuring agent solidifies into a solid-like mass containing the dispersed sorbitan ester. The solidified mass is then further treated to form particles suitable for admixing into granular laundry products by any number of ways, including, but not limited to, flaking, crushing, and/or grinding. Flaking involves milling or extruding the molten mixture to form a thin sheet, cooling to solidify the structuring agent, and breaking the sheet into particles of the right size. An alternative method can be used where thin films are formed by cooling the molten mixture of structuring agent and sorbitan ester on, e.g., a chill roll or belt cooler and then breaking the film into appropriate sized flakes.

Another way of forming the admix particles is to prill the molten mixture through a cooling tower, a common procedure known in the detergent industry. A discussion of various prilling techniques is found in *Perry's Chemical Engineers' Handbook* (Sixth Ed., 1984) on pages 8–70 to 8–71, which is incorporated herein by reference. One of ordinary skill in the art will recognize that there are numerous variations to the above-described methods as well as other methods known in the detergent industry that will accomplish the objective of forming the detergent admix particles from the mixture of sorbitan ester and structuring agent.

The detergent admix particles formed from the molten mixture of sorbitan ester and structuring agent are screened to select particles of appropriate size for inclusion in granular laundry products. The admix composition described herein encompasses detergent admix particles of from about 100 microns to about 2000 microns, preferably from about 200 microns to about 1500 microns, most preferably from about 300 microns to about 1000 microns.

DETERGENT COMPONENTS

The free-flowing particulate detergent admix containing nonionic surfactant can be incorporated into a fully formulated granular laundry detergent composition having a variety of common detergent ingredients including a surfactant system. The surfactant system of the granular laundry detergent can include anionic, nonionic, zwitterionic, ampholytic and cationic classes and compatible mixtures thereof. Detergent surfactants are described in U.S. Pat. No. 3,664,961, Norris, issued May 23, 1972, and in U.S. Pat. No. 3,919,678, Laughlin et al., issued Dec. 30, 1975, both of which are incorporated herein by reference. Cationic surfactants include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference.

Nonlimiting examples of surfactant systems include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y$ $(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the surfactant system. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

The granular detergent composition to which the particulate detergent admix can be added can, and preferably does, include a detergent builder. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above. Preferred for use herein are the phosphates, carbonates, silicates, $C_{10-18}$ fatty acids, polycarboxylates, and mixtures thereof. More preferred are sodium tripolyphosphate, tetrasodium pyrophosphate, citrate, tartrate toorio- and di-succinates, sodium silicate, and mixtures thereof (see below).

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the nonsoap anionic surfactant.

Other suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2.M_2O$, M being an alkali metal, and having a $SiO_2$:$M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized, as well.

Any number of additional ingredients can also be included as components in the granular detergent composition. These include other detergency builders, bleaches, bleach activators, suds boosters or suds suppressors, anti-tarnish and anti-corrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al., issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al., issued May 5, 1987, both incorporated herein by reference.

Additionally, the present admix composition can also include a flow aid to further improve flow properties. Typical flow aids include zeolite, fine carbonate, and fumed silicas. When present in the admix composition herein, flow aids may comprise from about 0.1% to about 30% by weight of the particulate detergent admix, preferably from about 5% to about 25%, most preferably from about 10% to about 20%.

The following examples illustrate the advantages of the admix composition herein. Examples I, II, and III show admix compositions employing sorbitan esters without structuring agents. The admixes of Examples I, II, and III have physical properties which make them unacceptable for incorporation into detergent products. Examples IV and V show free-flowing particulate detergent admix compositions containing polyethoxylated and nonethoxylated sorbitan esters combined with a structuring agent. The admixes of Examples IV and V have excellent physical properties for inclusion in detergent products, with the flowability of the admix of Example V being superior to that of Example IV.

EXAMPLE I

Polyoxyethylene (20) sorbitan tristearate (GLYCOSPERSE TS-20, purchased from Lonza Inc.) was melted at a temperature greater than it's melting point to form a liquid. The liquid was then spread out onto aluminum foil to form a thin sheet approximately 1–2 mm thick, and allowed to cool to a room temperature of 21.1° C. Upon cooling, the thin sheet of liquid sorbitan ester solidified. After solidification, the thin sheet was removed from the aluminum foil and granulated in a CUISINART food processor. The granulated admix particles were screened using a Tyler 10 mesh screen having screen openings of 1.70.

The admix particles produced by the above process had unacceptable properties for inclusion in detergent products. The particles were soft, slightly sticky, and remelted into a single mass after aging for 3 days at room temperature.

EXAMPLE II

Polyoxyethylene (20) sorbitan monostearate (GLYCOSPERSE S-20, purchased from Lonza Inc.) was melted at a temperature greater than it's melting point to form a liquid. The liquid was then spread out onto aluminum foil to form a thin sheet approximately 1–2 mm thick, and allowed to cool to a room temperature of 21.1° C. Upon cooling, the thin sheet of liquid sorbitan ester solidified. After solidification, the thin sheet was removed from the aluminum foil and granulated in a CUISINART food processor. The granulated admix particles were screened using a Tyler 10 mesh screen having screen openings of 1.70 mm.

The admix particles produced by the above process had unacceptable properties for inclusion in detergent products. The particles were soft, slightly sticky, and remelted into a single mass after aging for 3 days at room temperature.

EXAMPLE III

Polyoxyethylene (20) sorbitan tristearate (GLYCOSPERSE TS-20, purchased from Lonza Inc.) and sorbitan monostearate (LONZEST SMS, purchased from Lonza Inc.) were separately melted at temperatures greater than their melting points to form liquids. A mixture was then formed of 75% by weight of the liquid polyoxyethylene (20) sorbitan tristearate and 25% by weight of the liquid sorbitan monostearate. The liquid mixture was then spread out onto aluminum foil to form a thin sheet approximately 1–2 mm thick, and allowed to cool to a room temperature of 21.1° C. Upon cooling, the thin sheet of liquid sorbitan ester mixture solidified. After solidification, the thin sheet was removed from the aluminum foil and granulated in a CUISINART food processor. The granulated admix particles were screened using a Tyler 10 mesh screen having screen openings of 1.70 mm.

The admix particles produced by the above process had unacceptable properties for inclusion in detergent products. The particles were slightly sticky and showed some caking upon extended storage. Further, the caking which occurred did not break-up easily. The composition of the admix particles produced by the above-described process is presented in Table I:

TABLE I

| Detergent Admix Component | (% Weight) |
|---|---|
| Polyoxyethylene (20) sorbitan tristearate[1] | 75.0 |
| Sorbitan monostearate[2] | 25.0 |
| Total | 100.0 |

[1]Manufactured under the trade name GLYCOSPERSE TS-20 by Lonza, Inc.
[1]Manufactured under the trade name LONZEST SMS by Lonza, Inc.

EXAMPLE IV

Polyoxyethylene (20) sorbitan tristearate (GLYCOSPERSE TS-20, purchased from Lonza Inc.), sorbitan monostearate (LONZEST SMS, purchased from Lonza Inc.), and polyethylene glycol (CARBOWAX PEG 8000, purchased from Union Carbide, Co.) were separately melted at temperatures greater than their melting points to form liquids. A mixture was then formed of 56.25% by weight of the liquid polyoxyethylene (20) sorbitan tristearate, 18.75% by weight of the liquid sorbitan monostearate, and 25% by weight of the polyethylene glycol. The liquid mixture was then spread out onto aluminum foil to form a thin sheet approximately 1–2 mm thick, and allowed to cool to a room temperature of 21.1° C. Upon cooling, the thin sheet of the mixture solidified. After solidification, the thin sheet was removed from the aluminum foil and granulated in a CUISINART food processor. The granulated admix particles were screened using a Tyler 10 mesh screen having screen openings of 1.70 mm.

The admix particles produced by the above process had acceptable properties for inclusion in detergent products. The particles were free-flowing and showed little caking upon extended storage. Further, what caking that did occur after extended storage was easily broken by minor disturbance of the admix. The composition of the admix particles produced by the above-described process is presented in Table II:

TABLE II

| Detergent Admix Component | (% Weight) |
|---|---|
| Polyoxyethylene sorbitan tristearate[1] | 56.25 |
| Sorbitan monostearate[2] | 18.75 |
| Polyethylene glycol[3] | 25.0 |
| Total | 100.00 |

[1]Manufactured under the trade name GLYCOSPERSE TS-20 by Lonza, Inc.
[2]Manufactured under the trade name LONZEST SMS by Lonza, Inc.
[3]Manufactured under the trade name CARBOWAX 8000 by Union Carbide, Co.

EXAMPLE V

Polyoxyethylene (20) sorbitan tristearate (GLYCOSPERSE TS-20, purchased from Lonza Inc.), sorbitan monostearate (LONZEST SMS, purchased from Lonza Inc.), and polyethylene glycol (CARBOWAX PEG 8000, purchased from Union Carbide, Co.) were separately melted at temperatures greater than their melting points to form liquids. A mixture was then formed of 25% by weight of the liquid polyoxyethylene (20) sorbitan tristearate, 25% by weight of the liquid sorbitan monostearate, and 50% by weight of the polyethylene glycol. The liquid mixture was then spread out onto aluminum foil to form a thin sheet approximately 1–2 mm thick, and allowed to cool to a room temperature of 21.1° C. Upon cooling, the thin sheet of the mixture solidified. After solidification, the thin sheet was removed from the aluminum foil and granulated in a CUISINART food processor. The granulated admix particles were screened using a Tyler 10 mesh screen having screen openings of 1.70 min.

The admix particles produced by the above process had excellent properties for inclusion in detergent products. The particles were free-flowing and showed extremely little caking upon extended storage. Further, what little caking that did occur after extended storage was easily broken by minor disturbance of the admix. The flowability of the admix composition was superior to the admix of Example IV. The composition of the admix particles produced by the above-described process is presented in Table III:

TABLE III

| Detergent Admix Component | (% Weight) |
|---|---|
| Polyoxyethylene sorbitan tristearate[1] | 25.0 |
| Sorbitan monostearate[2] | 25.0 |

TABLE III-continued

| Detergent Admix Component | (% Weight) |
|---|---|
| Polyethylene glycol[3] | 50.0 |
| Total | 100.0 |

[1]Manufactured under the trade name GLYCOSPERSE TS-20 by Lonza, Inc.
[2]Manufactured under the trade name LONZEST SMS by Lonza, Inc.
[3]Manufactured under the trade name CARBOWAX 8000 by Union Carbide, Co.

Having thus described the invention in detail, it will be obvious to those skilled in the art that various changes may be made without departing from the scope of the invention and the admix composition is not to be considered limited to what is described in the specification.

What is claimed is:

1. A free-flowing particulate detergent admix composition for inclusion in a granular detergent product comprising:

a) from about 40% to about 60% by weight of a mixture of sorbitan esters having the formula:

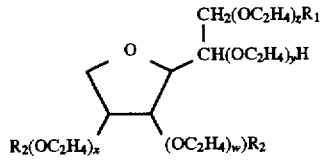

wherein said mixture comprises polyethoxylated sorbitan tristearate, wherein $R_1$ and $R_2$ are $(C_nH_{2n+1})COO$, n is 17, and W+X+Y+Z equals from 0 to 40, and sorbitan monostearate, wherein $R_1$ is $(C_nH_{2n+1})COO$, n is $R_1$, $R_2$ is (OH), and W+X+Y+Z equals 0, wherein the weight ratio of polyethoxylated sorbitan tristearate to sorbitan monostearate is from about 1.0:3.0 to about 3.0:1.0; and b) from about 40% to about 60% by weight of a polyethylene glycol having a melting point above room temperature, wherein the molecular weight of the polyethylene glycol is from about 1,500 to about 100,000.

2. The particulate detergent admix composition of claim 1, wherein the melting point of the particulate detergent admix composition is greater than 37.8° C.

3. The particulate detergent admix composition of claim 1, wherein the polyethoxylated sorbitan tristearate has 20 ethoxy groups, wherein W+X+Y+Z equals 20.

4. The particulate detergent admix composition of claim 1, wherein the mean particle size of the particulate detergent admix is from about 100 microns to about 2000 microns.

5. A method of laundering soiled .fabrics comprising the step of contacting said soiled fabrics with an aqueous solution containing an effective amount of a detergent product containing the particulate detergent admix composition of claim 1.

* * * * *